US006022843A

United States Patent [19]

Shanks et al.

[11] Patent Number: 6,022,843

[45] Date of Patent: Feb. 8, 2000

[54] NON-PHOSPHATE, AGGLOMERATED LAUNDRY BOOSTER

[75] Inventors: Philip C. Shanks, Castro Valley; Arnold J. Lim, Pittsburg; William P. Sibert, San Ramon, all of Calif.

[73] Assignee: The Clorox Company, Oakland, Calif.

[21] Appl. No.: 09/151,188

[22] Filed: Sep. 9, 1998

[51] Int. Cl.[7] ..... C11D 17/06; C11D 10/02; C11D 3/10; C11D 7/60

[52] U.S. Cl. ..... 510/444; 510/486; 510/509; 510/531

[58] Field of Search ..... 510/444, 486, 510/460, 509, 531

[56] References Cited

U.S. PATENT DOCUMENTS

| | | | |
|---|---|---|---|
| 3,986,987 | 10/1976 | D'Souza | 252/527 |
| 4,992,079 | 2/1991 | Lutz | 23/313 R |
| 5,164,108 | 11/1992 | Appel et al. | 252/174 |
| 5,282,996 | 2/1994 | Appel et al. | 252/100 |
| 5,665,691 | 9/1997 | France et al. | 510/444 |

FOREIGN PATENT DOCUMENTS 2221695 2/1990 United Kingdom .

OTHER PUBLICATIONS

Dialog Select Report on CN 1,117,077, Feb. 21, 1996, "Super Strong Detergent Powder," Abstract.

Co–pending U.S. Patent Application Serial No. 08/748,652, filed Nov. 14, 1996, of Blum et al., entitled "Powdered Abrasive Cleanser."

Co–pending U.S. Patent Application Serial No. 08/718,059, filed Sep. 17, 1996, of Garner et al. "Cleaner with Water Soluble Abrasive."

*Primary Examiner*—John Petruncio

*Attorney, Agent, or Firm*—Joel J. Hayashida

[57] ABSTRACT

The invention is an improved, non-phosphate, non-bleach, agglomerated laundry booster which has a) a solids portion with i) at least 5% by weight of a first builder selected from the group consisting of alkali metal carbonate, alkali metal bicarbonate, alkali metal sesquicarbonate, and mixtures thereof; and ii) a second builder of at least 25% by weight alkali metal tetraborate pentahydrate; and b) i) a first liquid which comprises an anionic, acidic surfactant, in an amount no greater than about 10% by weight; and ii) a second liquid which comprises an agglomerating agent. The first liquid is neutralized by the first builder of a)i) to form a first set of particles, the second builder forms a second set of particles, and the second liquid co-agglomerates both the first and second sets of particles. The invention also provides a method for preparing this laundry booster.

8 Claims, No Drawings

NON-PHOSPHATE, AGGLOMERATED LAUNDRY BOOSTER

BACKGROUND OF THE INVENTION

1. Field of the Invention

This invention relates to an improved, non-phosphate, non-bleach, agglomerated laundry booster which improves the performance of standard commercial laundry detergents in diverse wash liquor temperatures.

2. Description of Related Art

Bleaching compositions have long been used in households for the bleaching and cleaning of fabrics. Liquid and dry bleaches based upon hypochlorite chemical species have been used extensively, as they are inexpensive, highly effective, easy to produce, and stable. However, the advent of modem synthetic dyes and the use of modern automatic laundering machines have introduced new requirements in bleaching techniques, and have created a need for other types of bleaching compositions. In order to satisfy this need, peroxygen bleaches are sold which generate hydroperoxide ion, such as sodium perborate tetra- and monohydrate, as the oxidizing species. Alternatively, some manufacturers have experimented with so-called reducing bleaches, in which the "bleaching" agent is sodium thiosulfate. Despite the variety of laundry bleaches for use in various situations, certain consumers prefer to have yet further choices in improving the wash performance of laundry detergents and the resulting appearance of their washed fabrics.

France et al., U.S. Pat. No. 5,665,691, discloses a process for making a low density detergent composition by agglomerating a detergent surfactant paste and a dry starting material (builder) in which unpuffed borax pentahydrate, sodium carbonate and sodium phosphate are combined and then dried to a density of 300 g/L to about 450 g/L. France achieves fluffy particles by the essential step of drying its agglomerates in a drying apparatus with a minimum temperature of at least 50° C. (122° F.) and most preferably, as stated in its Example, at a temperature of about 200° C. (392° F.). Its process could be described as a method of puffing, or dehydrating, borax in situ. Moreover, besides the added energy required to produce the agglomerates of France et al., there is the added disadvantage of incorporating phosphates, which are less desirable now because of existing legislation in various regions to diminish or avoid their use in laundry and cleaning products.

Alkali metal tetraborate pentahydrate, also known as borax pentahydrate, has been used as a water soluble abrasive in co-pending and commonly assigned U.S. patent application Ser. No. 08/748,652, filed Nov. 14, 1996, of Blum et al., entitled "Powdered Abrasive Cleanser," and Ser. No. 08/718,059, filed Sep. 17, 1996, of Garner et al., entitled "Cleaner with Water Soluble Abrasive." However, both of these applications contemplate the use of borax pentahydrate as a water soluble abrasive in a hard surface cleaning and scouring application, and not as a builder in a fabric washing application, in which undissolved particulate matter, which may lead to residue on fabrics, is generally highly desirable to be avoided.

SUMMARY OF THE INVENTION

The invention provides an improved, non-phosphate, non-bleach, agglomerated laundry booster which has a) a solids portion with i) at least 5% by weight of a first builder selected from the group consisting of alkali metal carbonate, alkali metal bicarbonate, alkali metal sesquicarbonate, and mixtures thereof; and ii) a second builder of at least 25% by weight alkali metal tetraborate pentahydrate; and b)i) a first liquid which comprises an anionic, acidic surfactant, in an amount no greater than about 10% by weight; and ii) a second liquid which comprises an agglomerating agent The first builder of a)i) is used to neutralize the first liquid to form a first set of particles, the second builder forms a second set of particles, and the second liquid co-agglomerates both the first and second sets of particles. The invention also provides a method for preparing this laundry booster.

It is therefore an object of this invention to provide to users of commercial laundry detergents an alternative laundry additive to bleaches for improving wash performance and the appearance of laundered fabrics.

It is another object of this invention to provide an agglomerated, non-phosphate, non-bleach laundry booster, which leaves substantially no or little residue on fabrics washed therewith.

It is a further object of this invention to provide a method for preparing an agglomerated, non-phosphate, non-bleach laundry booster in which heat-sensitive additives, such as enzymes and fragrances, can be more readily added because the laundry booster is produced in a continuous process at a temperature amenable to the addition of such heat-sensitive additives.

It is a still further object of this invention to provide a method for preparing an agglomerated, non-phosphate, non-bleach laundry booster in which small amounts of surfactant (relative to laundry detergents) are used because the laundry booster is processed in a continuous process at temperatures amenable to low level surfactant addition.

It is also an object of this invention to provide an inexpensive, effective laundry booster with proficient anti-encrustation performance.

It is additionally an object of this invention to achieve agglomerates of a specific density range of 600–800 g/L, which has been found to be optimal in the consumer usage of the inventive laundry booster.

DETAILED DESCRIPTION OF THE INVENTION

The invention provides an improved, non-phosphate, non-bleach, agglomerated laundry booster which has a) a solids portion with i) at least 5% by weight of a first builder selected from the group consisting of alkali metal carbonate, alkali metal bicarbonate, alkali metal sesquicarbonate, and mixtures thereof; and ii) a second builder of at least 25% by weight alkali metal tetraborate pentahydrate; and b) i) a first liquid which comprises an anionic, acidic surfactant, in an amount no greater than about 10% by weight; and ii) a second liquid which comprises an agglomerating agent The first liquid is neutralized by the first builder of a)i) to form a first set of particles, the second builder forms a second set of particles, and the second liquid co-agglomerates both the first and second sets of particles.

The invention also provides a method for preparing this laundry booster. This is done by providing a solids portion which comprises: i) at least 5% by weight of a first builder selected from the group consisting of alkali metal carbonate, alkali metal bicarbonate, alkali metal sesquicarbonate, and mixtures thereof, and ii) a second builder at least 25% by weight alkali metal tetraborate pentahydrate;

Neutralizing a first liquid which comprises an anionic, acidic surfactant, in an amount no greater than about 10% by weight with said first builder of a)i) to form a first set of particles; and Co-agglomerating said first set of particles and a second set of particles comprising said second builder of a)ii), with a second liquid (the agglomerating agent). The agglomerate is mixed with any additional dry ingredients in a mixing means, such as a rotary, static or tumble mixer.

Unless indicated to the contrary, all percentages, ratios, or parts are determined by weight.

1. Alkaline Builder

An alkaline builder material is added to provide to a pH of between about 8–12 in the wash liquor. The builder also has the capacity to sequester or precipitate hardness ions (e.g,. $Ca^{2+}$ and $Mg^{2+}$). Alkali metal carbonates, sesquicarbonates and bicarbonates are suitable builders, and especially preferred are sodium and/or potassium carbonates. The carbonate (also known as soda ash) acts as the builder to remove divalent metal ions such as calcium, and additionally provides alkalinity and aids in soil removal. Generally, in terms of wt. % of the composition, at least about 5%, preferably 15%, most preferably at least 20% carbonate is employed. Higher levels can be employed, however, at levels greater than about 90% there is insufficient room for the other ingredients which contribute to the overall effectiveness of the composition. The alkaline builder acts to neutralize the acidic, liquid surfactant of 3. below, and, in the process, forms a first set of particles for agglomeration. Some added water (about 0.1–3%) may be desirable to condition the alkaline builder before or during the addition of the acidic, liquid surfactant Especially preferred carbonates are the disodium carbonates produced by FMC Corporation under the brand name Absorpta Plus, which is apparently a calcined carbonate.

2. Alkali Metal Tetraborate Pentahydrate

Also known as borax pentahydrate, it is more properly named di-alkali metal, tetraborate pentahydrate. The alkali metal counterion is most preferably sodium, although lithium and potassium are both possible. Borax pentahydrate in the invention, however, plays the critical role of acting to improve washing performance, in reducing residual matter on washed fabrics (anti-encrustation), and acting as a co-builder with the alkaline builder in 1., above. Further, borax pentahydrate, unlike borax decahydrate, more commonly known as "ordinary" borax, is a flowable material much less susceptible to clumping, leading to much greater ease in processing and transportation. It is also typically much less dusty than borax decahydrate.

Borax pentahydrate, as a sodium salt, has the formula $Na_2B_4O_7$ $5H_2O$ and has properties analogous, but not identical, to borax decahydrate. It is commercially available from North American Chemical Company, as V-Bor®, and U.S. Borax Inc. as Neobor®. The significant difference between the two products is that Neobor® has a larger particle size. In general, however, the preferred borax pentahydrate has a particle size such that the majority passes through a 12 U.S. Mesh sieve (~1,700$\mu$). The borax pentahydrate forms the second set of particles which is agglomerated with the agglomerating agent described in 4. below.

The amount of borax pentahydrate present varies, but is generally an amount which exceeds about 25% by weight, more preferably exceeding about 40% and most preferably exceeding about 50%, of the entire composition. In general, the ratio between the borax pentahydrate and the alkaline co-builder in 1. above may generally vary from about 10:1 to about 1:1.

3. Acidic, Liquid Surfactant

The acidic liquid surfactant is present to improve detergency of the inventive laundry booster and secondarily to help agglomerate the particles, which are the alkaline builder and the borax pentahydrate. The preferred acidic liquid surfactant is an anionic surfactant, for example, selected from linear or branched $C_{6-20}$ alkylarylsulfonic acids, $C_{6-20}$ alkylsulfonic acids, $C_{6-20}$ alkylsulflric acids, $C_{6-20}$ alkylcarboxylic acids and mixtures thereof. Exemplary materials are alkylbenzene sulfonic acids, such as Biosoft S100 and S130 (non-neutralized linear alkylbenzene sulfonic acid, which is referred to as "HLAS") from Stepan Company. If the anionic surfactant is an acidic HLAS, it is neutralized in situ with an alkaline material such as the alkaline builders of 1. above, namely, $Na_2CO_3$, $NaHCO_3$, or sesquicarbonates, and other alkali metal salts are desirable, as well. These acidic surfactants possess a higher actives level and can be cost-effective. Additionally, relatively low temperatures (no greater than about 100° C.) are used in the processing of the inventive laundry booster, and these are amenable to low level addition of surfactant. It may be desirable to add discrete amounts of additional liquid surfactants, such as nonionic surfactants, to improve washing performance, especially on greasy or oily soils. (See, Sells et al., U.S. Pat. No. 5,789,364, column 4, line 33 to column 5, line 18, and DeLeeuw et al., U.S. Pat. No. 5,589,448, column 4, line 46, to column 5, line 47, the disclosures of which are incorporated herein by reference thereto.)

The amount of surfactant is generally between about 0.01 to about 10%.

4. Agglomerating Agent

The agglomerating liquid is a further essential component of the invention and is selected from the aqueous solutions of water soluble polymers, alkali metal silicates, and mixtures thereof The principal feature of the agglomerating liquid, or agent, is to act as the "glue" agglomerating the two sets of particles (acidic surfactant-neutralized alkaline builder and borax pentahydrate, respectively) together into usable masses of low friability, which themselves are "particles " of relatively larger sizes. While water soluble polymers, such as aqueous solutions of polyacrylic acid, polyacrylate, acrylic acid co-monomers, polyvinyl acetate, polyvinyl alcohol, gums (guar, xanthan), polysaccharides, starch, corn syrups, and the like, are suitable agglomerating agents, they sometimes can add unnecessary cost to the formulated composition and do not, except for certain polymers which can act as anti-encrustation agents, really add to the fabric washing performance. So, alkali metal silicates, such as sodium silicate, in aqueous solution, are especially preferred from a processing, performance and cost (very inexpensive) standpoint. Alkali metal silicate solution, upon flashing off/volatizing water, binds materials very proficiently. Additionally, since the silicate is an alkaline builder, it adds to the performance of the inventive laundry booster, which performs well in alkaline pH (8–12). It is also known to inhibit corrosion of metal surfaces in washing appliances. Further, it has been found that there is an especially preferred solution used in the processing of the invention which leads to excellent agglomeration, with resulting "crisp " agglomerates of low friability. In the processing of the agglomerates, it has been surprisingly found that an aqueous solution of about 40–45% sodium silicate results in excellent final particle size and density. Apparently, exceeding this percentage can lead to the formation of a premature "skin " or film on the agglomerates, resulting in a weak agglomerated particle because water cannot vaporize from within the particle, while using a lesser percentage solution results in a agglomerating liquid of very weak binding capacity. This was an especially surprising finding.

5. Adjuncts

Adjuncts may be added in an amount of from 0 to about 5% and are useful to improve or enhance efficacy, aesthetics and/or consumer acceptance of the overall formulation. Enzymes are a particularly preferred adjunct, and may be selected from the hydrolases, such as amylases, proteases, cellulases, and lipases. The hydrolytic enzyme should be present in an amount of about 0.01–2%, more preferably about 0.5–1%, by weight of the detergent. Mixtures of any of the foregoing hydrolases are desirable, especially protease/amylase blends. In the invention, because there is no oxidant or other material which can be damaging to enzymes, the environment therein is very favorable for the inclusion of these and other such oxidant sensitive adjuncts. Additionally, the method for making the laundry booster is conducted at relatively low temperatures conducive to the addition of enzymes, which thus favors the inclusion of such enzymes.

Dyes, such as Monastral blue and anthraquinone dyes (such as those described in Zielske, U.S. Pat. Nos. 4,661,293 and 4,746,461), and pigments, e.g. titanium dioxide and ultramarine blue which are also suitable colorants, can be selected. Anti-redeposition agents, such as carboxymethylcellulose, are potentially desirable.

Fluorescent whitening agents (FWAs) are desirable components for inclusion in bleaching formulations, as they counteract the yellowing of cotton and synthetic fibers. FWAs are absorbed on fabrics during the washing and/or bleaching process. FWAs function by absorbing ultraviolet light, which is then emitted as visible light, generally in the blue wavelength ranges. The resultant light emission yields a brightening and whitening effect, which counteracts yellowing or dulling of the bleached fabric. Such FWAs are available commercially from sources such as Ciba Geigy A.G. under the brand name Tinopal and from Bayer A.G. under the brand name Blankophor. Incorporation of the FWAs may be afforded by mixing a binding agent and bulking agents e.g. $Na_2SO_4$, and dyes, pigments, or colorants (See, Iliff et al., U.S. Pat. No. 5,605,883, incorporated herein by reference), or, may simply be post-added to the laundry booster without any bulling or binding agent. The mixture could also be compacted to form particles or speckles, which are admixed into the product. If added, the FWA particles may comprise from about 0.1% to 5% by weight of the composition.

A fragrance which imparts a pleasant odor to the composition is generally included. The fragrances may also be protected by encapsulation in polymeric materials such as polyvinyl alcohol, or by absorbing them into starch or sugar and forming them into beads. However, the level of fragrance added should be quite low, owing to their relatively high cost and high performance in relatively low amounts.

While other buffering, co-building, and/or bulking agents may also be present, they generally are not needed. For example, phosphates, such as sodium orthophosphate, sodium tripolyphosphate, have been implicated in eutrophication of water and, as a result, have inspired legislation restricting or proscribing their use. Other materials, such as aluminosilicates (zeolites), are effective, but also quite expensive and thus, less preferred. Organic builders may be used, such as sulfosuccinates, maleates, succinates, but may also add ftrther costs. Optionally, fillers such as sodium sulfate or sodium chloride may be added. Residual moisture from the aqueous solutions used in making the inventive laundry booster may contribute to a water level of from 0.5 to about 6.0%.

EXPERIMENTAL

The following preferred example discloses a best mode of the invention:

EXPERIMENTAL

The following preferred example discloses a best mode of the invention:

| Description of Ingredient | Weight % |
|---|---|
| Disodium tetraborate pentahydrate | 58.1 |
| Disodium carbonate | 26.8 |
| Sodium silicate | 4.5 |
| $C_{13}$ alkylbenzenesulfonic acid | 4.4 |
| Brightener (FWA) | 0.45 |
| Enzymes (protease and amylase) | 1 |
| Color speckle | 2 |
| Fragrance | 0.15 |
| Residual Water | 2.6 |
| Total | 100 |

As previously described herein, the first dry ingredient, namely, the carbonate, is used to dry neutralize the acidic surfactant, $C_{13}$ alkylbenzenesulfonic acid. This not only absorbs the liquid surfactant, it also results in the first set of particles in a technique known as "preloading." A small quantity of water (0.1–3%) may be added to speed up neutralization. This first set of particles is then combined with the second set of particles, namely the borax pentahydrate, and these first and second sets of particles are co-agglomerated with the sodium silicate solution. Generally speaking, dry ingredients are added with dry ingredients, wet ingredients with wet. A standard commercial mixer, such as a Schugi agglomerator, or Hobart, or other brand is used. Unlike prior art, e.g., the France patent, excessively high temperatures needed to puff or dehydrate borax pentahydrate in situ are avoided. Instead, a fluid bed dryer is used to drive off excess amounts of residual moisture, to result in the crisp agglomerates of low friability. The fluid bed dryer consists generally of 3 drying zones: a first zone set at about 70–90° C., a second at 30–80° C., and a final at ambient to 50° C. This results in desirable agglomerates having a density of about .60–80 g/cc (or, 600–800 g/L). An Oahus apparatus or other loose bulk density measuring device was used to determine this. The desired density has been found to be optimal in wash performance. Agglomerated particles in the inventive laundry booster have proven to be superior to dry mixes of the individual ingredients. Dry mixtures will have undesirable dustiness. Also, agglomerates will lead to desirably uniform particle size and ingredient distribution, resulting in predictable and consistent product dosage. Contrast that to the dry mixtures, in which ingredients of differing particle sizes may result in segregation and therefore, non-uniform distribution, thus leading to undesirable or inconsistent product performance.

While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

We claim:

1. A non-phosphate, non-bleach agglomerated laundry booster comprising:

a) a first set of particles, comprising an alkaline builder, at least a portion of which has been used to neutralize in situ an acidic, liquid surfactant, in which:

(i) said alkaline builder is at least 5% by weight of the agglomerated laundry booster, said alkaline builder being selected from the group consisting of alkali metal carbonate, alkali metal bicarbonate, alkali metal sesquicarbonate, and mixtures thereof, and (ii) said acidic liquid surfactant is about 0.01–10% of the agglomerated laundry booster, said acidic liquid surfactant being selected from the group consisting of $C_{6-20}$ alkylarylsulfonic acids, $C_{6-20}$ alkylsulfonic acids, $C_{6-20}$ alkylsulfuric acids, $C_{6-20}$ alkylcarboxylic acids and mixtures thereof;

b) a second set of particles comprising at least 25% by weight of the agglomerated laundry booster of an alkali metal tetraborate pentahydrate;

c) a liquid agglomerating agent selected from the aqueous solutions of water soluble polymers, alkali metal silicates, and mixtures thereof;

said liquid agglomerating agent of c) co-agglomerating said first and second sets of particles, the agglomerates thus formed of said first and second sets of particles having a density of about 0.60–0.80 g/cc.

2. The laundry booster of claim 1 wherein said first liquid is a $C_{6-20}$ alkylarylsulfonic acid.

3. The laundry booster of claim 1 wherin said agglomerating agent is an alkali metal silicate.

4. The laundry booster of claim 1 further comprising d) an adjunct selected from the group consisting of fluorescent whitening agents, enzymes, dyes, colorants, pigments, fragrances and residual moisture.

5. A method for preparing a non-phosphate, non-bleach agglomerated laundry booster comprising:

a) Providing a first set of panicles by neutralizing an acidic surfactant selected from the group consisting of $C_{6-20}$ alkylarylsulfonic acids, $C_{6-20}$ alkyIsulfonic acids, $C_{6-20}$ alkylsulfliric acids, $C_{6-20}$ alkylcarboxylic acids and mixtures thereof, in an amount no greater than about 10% by weight of the agglomerated laundry booster, with a first builder in an amount of at least 5% by weight of the agglomerated laundry booster, said first builder being selected from the group consisting of alkali metal carbonate, alkali metal bicarbonate, alkali metal sesquicarbonate, and mixtures thereof;

b) Providing a second set of particles, said second set of particles comprising a second builder of at least 25% by weight of the agglomerated laundry booster of an alkali metal tetraborate pentahydrate; and c) Co-agglomerating said first set of particles and a second set of particles, with a liquid agglomerating agent selected from the aqueous solutions of water soluble polymers, alkali metal silicates, and mixtures thereof at a temperature sufficiently low to avoid forming puffed or dehydrated borax, the agglomerates thus formed of said first and second sets of particles having a density of about 0.60–0.80 g/cc.

6. The method of claim 5 wherein said agglomerating agent is an alkali metal silicate.

7. The method of claim 5 wherein said alkali metal silicate is in an aqueous solution at a level of 40–45%.

8. The method of claim 5 wherein in step a), a small quantity of water is optionally added to speed upthe neutralization of said anionic, acidic surfactant.

* * * * *